US007819778B1

(12) United States Patent
Sudeith et al.

(10) Patent No.: US 7,819,778 B1
(45) Date of Patent: Oct. 26, 2010

(54) SAFETY MAT SECUREMENT ASSEMBLY

(75) Inventors: Timothy S. Sudeith, Edina, MN (US); Dwight Porter, St. Paul, MN (US); Linda Booth, Burnsville, MN (US)

(73) Assignee: Everlast Climbing Industries, Inc., Mendota Heights, MN (US)

( * ) Notice: Subject to any disclaimer, the term of this patent is extended or adjusted under 35 U.S.C. 154(b) by 0 days.

(21) Appl. No.: 11/705,296

(22) Filed: Feb. 12, 2007

Related U.S. Application Data

(63) Continuation-in-part of application No. 11/061,583, filed on Feb. 18, 2005.

(60) Provisional application No. 60/772,055, filed on Feb. 10, 2006.

(51) Int. Cl.
*A63B 7/04* (2006.01)
*A63B 9/00* (2006.01)

(52) U.S. Cl. ..... 482/37

(58) Field of Classification Search ..... 482/23, 482/35–37, 38, 39; 5/639, 640, 697, 420, 5/907; D21/826; 434/247
See application file for complete search history.

(56) References Cited

U.S. PATENT DOCUMENTS 1,688,583 A * 10/1928 Horne ..... 211/87.01
3,242,509 A * 3/1966 Nissen ..... 5/420
3,251,076 A * 5/1966 Burke ..... 428/116
3,262,134 A * 7/1966 Bramle, Jr. ..... 5/420
3,284,819 A * 11/1966 Nissen ..... 5/420
3,319,273 A * 5/1967 Solin ..... 5/420
3,399,407 A * 9/1968 Olsen ..... 482/15
3,526,911 A * 9/1970 Meyer et al. ..... 5/420
3,616,118 A * 10/1971 Porter ..... 428/82
3,636,577 A * 1/1972 Nissen ..... 5/420
4,137,583 A * 2/1979 Baldwin et al. ..... 5/420
4,350,721 A * 9/1982 Nagase ..... 428/33
4,574,101 A * 3/1986 Tricca et al. ..... 428/138
4,905,990 A * 3/1990 DeSantis ..... 482/23

(Continued)

FOREIGN PATENT DOCUMENTS

FR 2671015 A1 * 7/1992

*Primary Examiner*—Loan Thanh
*Assistant Examiner*—Daniel F Roland
(74) *Attorney, Agent, or Firm*—Anthony G. Eggink; Katrina M. Eggink

(57) ABSTRACT

A safety mat structure and associated securement assembly for providing open and closed positions for a climbing wall assembly. The safety mat securement assembly utilizes a plurality of security hand hold members each having latching means and a safety mat structure having bottom, top and side securement members. The security hand hold members may be used as hand holds on the climbing wall assembly and may have a locking structure. The bottom securement member functions to hold the safety mat to or near the bottom of a climbing wall assembly during both open and closed positions of the safety mat structure. The mat securement assembly is opened or unlocked by loosening the latching means, removing security mat top loop members from the hand hold, and placing the mats on the floor along the base of the climbing wall. When in the closed or locked position, the security mats may contain a printed message communicating that the climbing wall is closed and climbing should not take place. A top cover member may be provided to further secure the climbing wall. Safety mat cushioning structures and associated elements are further provided for use with climbing wall assemblies.

17 Claims, 5 Drawing Sheets

U.S. PATENT DOCUMENTS 5,092,587 A * 3/1992 Ulner et al. ..... 482/37
5,115,527 A * 5/1992 Medley ..... 5/731
5,125,877 A * 6/1992 Brewer ..... 482/7
5,212,842 A * 5/1993 Glydon ..... 5/420
5,372,550 A * 12/1994 Gleeson et al. ..... 472/116
5,384,923 A * 1/1995 Hwang et al. ..... 5/419
5,549,195 A * 8/1996 Aulagner et al. ..... 198/850
5,562,573 A * 10/1996 Harinishi ..... 482/23
5,643,139 A * 7/1997 Stout et al. ..... 482/14
5,732,954 A * 3/1998 Strickler et al. ..... 273/441
5,919,117 A * 7/1999 Thompson et al. ..... 482/37
5,941,041 A * 8/1999 Robinson et al. ..... 52/591.4
5,944,634 A * 8/1999 Neves ..... 482/37
6,074,327 A * 6/2000 Franklin ..... 482/37
6,082,545 A * 7/2000 Ford et al. ..... 206/579
6,083,142 A * 7/2000 Wilson ..... 482/37
6,231,482 B1 * 5/2001 Thompson ..... 482/37
6,390,952 B1 * 5/2002 Wilson ..... 482/37
6,402,663 B1 * 6/2002 Popp ..... 482/35
6,514,178 B2 * 2/2003 Vettori ..... 482/37
6,540,645 B1 * 4/2003 Zeilinger ..... 482/35
6,551,215 B1 * 4/2003 Gordon ..... 482/35
D478,145 S * 8/2003 Byrd et al. ..... D21/826
6,629,907 B2 * 10/2003 Popp ..... 482/35
6,699,158 B1 * 3/2004 Richardson et al. ..... 482/37
6,709,365 B2 * 3/2004 Zeilinger ..... 482/35
6,751,816 B1 * 6/2004 Wechsler ..... 5/417
6,761,563 B1 * 7/2004 Lin ..... 434/169
6,808,474 B2 * 10/2004 Tang ..... 482/51
6,849,031 B2 * 2/2005 Paci ..... 482/37
6,860,836 B1 * 3/2005 Wu ..... 482/37
6,872,167 B1 * 3/2005 Meissner ..... 482/37
6,920,655 B2 * 7/2005 Mitchell ..... 5/417
6,942,600 B2 * 9/2005 Zeilinger ..... 482/35
D518,137 S * 3/2006 Byrd et al. ..... D21/827
D521,099 S * 5/2006 Byrd et al. ..... D21/827
7,056,266 B2 * 6/2006 Sudeith ..... 482/37
7,195,582 B2 * 3/2007 Wu ..... 482/37
7,235,019 B1 * 6/2007 LeCher ..... 472/118
7,250,020 B2 * 7/2007 Barbafieri et al. ..... 482/35
2002/0098949 A1 * 7/2002 Popp ..... 482/37
2002/0169052 A1 * 11/2002 Godsey ..... 482/37
2003/0060333 A1 * 3/2003 Sudeith ..... 482/37
2003/0100407 A1 * 5/2003 Barbafieri et al. ..... 482/37
2003/0104910 A1 * 6/2003 McCoy ..... 482/142
2003/0153432 A1 * 8/2003 Zeilinger ..... 482/35
2003/0228956 A1 * 12/2003 Paci ..... 482/37
2004/0081946 A1 * 4/2004 Hensley ..... 434/247
2004/0088789 A1 * 5/2004 Mitchell ..... 5/420
2004/0097332 A1 * 5/2004 Zeilinger ..... 482/37
2004/0162190 A1 * 8/2004 Diamond et al. ..... 482/37
2004/0229732 A1 * 11/2004 Wang et al. ..... 482/37
2005/0059500 A1 * 3/2005 Finstein ..... 472/88
2005/0192160 A1 * 9/2005 Sudeith et al. ..... 482/37
2005/0233863 A1 * 10/2005 Zeilinger ..... 482/37
2005/0245355 A1 * 11/2005 Brewer et al. ..... 482/37
2006/0019798 A1 * 1/2006 Checketts et al. ..... 482/35
2006/0040811 A1 * 2/2006 Foster ..... 482/142
2006/0116244 A1 * 6/2006 Postma et al. ..... 482/37
2006/0128530 A1 * 6/2006 Gillett et al. ..... 482/35
2006/0240949 A1 * 10/2006 Wu ..... 482/37
2007/0082791 A1 * 4/2007 Reese et al. ..... 482/37
2007/0191188 A1 * 8/2007 Collins ..... 482/35
2007/0254779 A1 * 11/2007 Vanamo ..... 482/35

* cited by examiner

SAFETY MAT SECUREMENT ASSEMBLY

This application is a Continuation in Part of Applicants' Pre-Grant Publication US 2005/0192160 having Ser. No. 11/061,583, filed on Feb. 18, 2005 entitled Safety Mat Securement Assembly. This application claims the benefit of U.S. Provisional Patent Application No. 60/772,055, filed on Feb. 10, 2006.

BACKGROUND OF THE INVENTION

The present invention relates generally to climbing wall assemblies and to safety mats that are used in connection with climbing walls and in climbing wall environments. Particularly, this invention relates to a safety mat securing and locking assembly which is used in combination with the safety mats utilized for climbing wall structures. More particularly, this invention relates to safety mat structures and a handhold structure with a latch assembly constructed and arranged to secure the safety mats against the climbing wall when the latter is not in use. Further, the invention relates to mat securement features and other safety mat and cooperating climbing wall elements constructed and arranged to improve and to provide additional benefits in the use of safety mats with respect to climbing walls.

Artificial climbing and bouldering walls are increasingly popular and used due to the increase in physical fitness awareness generally and in the rock climbing and bouldering sports particularly. Climbing wall assemblies are being provided to introduce children into the climbing sports in a safe and educational manner. Such climbing wall assemblies are disclosed in U.S. Pat. No. 7,056,266, issued on Jun. 6, 2006, the teachings of which are fully incorporated by reference herein. Other climbing wall structures and environments are also known and for which the safety securement assembly of this invention may be utilized, for example, assembled climbing walls, indoor or outdoor, and existing wall structures such as concrete block, cinder block, paneled walls or like support structures.

In order to provide children and other climbers with a safe climbing environment, various safety features are utilized in conjunction with climbing wall assemblies. For example, safety mats may be provided on the floor areas adjacent and surrounding the climbing wall assembly so that should a climber fall, the landing area is padded. It is therefore desirable to secure the mats to or adjacent the climbing wall structure to ensure the proximity of the mats to the climbing wall. Artificial climbing walls are often located in a gym or designated play area where children may otherwise play. Thus, there is a need for a wall covering to protect children from running into the wall surface when not in use and to limit access to the climbing wall. Further, children, particularly young children, should be supervised when using the climbing wall. Thus, there is a need for a secure wall covering to prevent the unauthorized use of the climbing wall, for example, when proper supervision is not available or when the climbing wall is otherwise not available for use.

Although the prior art discloses the use of a cable system, for example, to secure a mat against a portion of the climbing wall, that system has been found cumbersome to utilize. The prior art also discloses safety mat securement systems that are located above the climbing wall structure. These systems are likewise burdensome because they may be located too high to be easily reached and are not aesthetically pleasing.

A need exists for a safety mat securement and locking assembly for use with climbing walls that secure the mat structure both when in use on the floor as a safety mat and when in use as a climbing wall covering. A further need exists for a mat securement assembly which is incorporated into a climbing wall and which is versatile and quick and easy to use. A further need exists for a mat securement system that warns children and other climbers that the wall is temporarily closed and that climbing should not take place. A further need exists to provide an identifiable mat structure which relates to its environment, which provides cushioning and which is economical to manufacture.

SUMMARY OF THE INVENTION

The safety mat and associated securement assembly of the invention may be constructed and arranged to provide an open or unlocked position and a closed or locked position for a safety mat structure used in, connection with a climbing wall structure. The safety mat securement assembly may comprise a plurality of security hand hold members or other locking securement structures that are incorporated into the climbing wall and which cooperate with a safety mat structure having a plurality of bottom, top and side attachment members which permit the mat structure to be positioned with respect to the climbing wall. The security handhold member may comprise a latching means which includes a latch member and a fastening member. The latch member preferably slides between an open position and a closed position and can be secured in either position using the fastening member. When in the open position the handhold member functions as an operative hand hold. The fastening member may be a screw structure, for example, having a unique head configuration which requires a cooperating wrench to loosen and tighten, i.e., a star-shaped screw head requiring a mating operating tool. A locking system may also be incorporated into or used in conjunction with the latching means. The security handhold members have means for fastening to a wall structure. Likewise, other locking structures may be utilized having means for fastening to or near the climbing wall structure.

A security mat structure constructed for use with the climbing wall preferably includes a covered cushioned structure having a plurality of attachment members, such as top loop members which are adapted to be looped into the security hand hold member, specifically around the latch member of the security hand hold member. Attachment or securement members are preferably located at the bottom end of the safety mat opposite the top loop members and function to hold the safety mat to the bottom of a wall climbing assembly during both open and closed positions of the safety mat. Attachment members, such as loop members may also be provided to extend from the sides of the mat structure and to be used with positioned handholds or other securement means to secure the sides of the mat to the wall to discourage side entry during periods of non-use. The bottom securement members may be a plurality of tabs or a continuous flap or have like configurations and which are secured to the wall by means of grommets and fasteners or plate/fastener structures. A top wall cover member may also be provided for use with the safety mat securement assembly to cover the exposed top portion of a climbing wall when the safety mats are in locked position over the climbing wall surface.

The securing assembly of the present invention may be opened or unlocked by loosening the bolt member with its corresponding tool or wrench, removing the mat loop members from the hand hold, and placing the mats on the floor along the base of the climbing wall. The bolt member may then be tightened in its open position so that the security handhold member may be used as a typical hand hold for the wall climbing. The security mats preferably have a printed message on the bottom side to communicate that the climbing wall is closed and climbing should not take place when the mat is secured to the wall, for example showing a "no climbing", "wall closed" or like message. The front and back surfaces of the mat cover may also be provided with an associated school name, school logo or other printed indicia. The bottom of the mat may also have window members secured thereto for receiving printed informational inserts. The cooperating top cover member also preferably has a viewable printed message when in use, for example a "climbing wall closed" message.

The safety mat securement assembly of the invention also provides safety mat structures having various structures for force impact absorbency including mat structures having foam layers, convoluted foam layers, layers having voids, rigid insert layers and inflatable mat structures. The safety mat structures may also be constructed of fire resistant materials. The safety mat may further have loop structures for attachment and cooperating securement handholds for securing the safety mat. Further provided are coated flap and tab structures, mat cutouts and other features to improve the use and function of the safety mat securement assembly. For example, the mat structure may be provided with removable cut outs to expose and accommodate the use of electrical wall plugs and vents when the mat structure is not in use.

It is an advantage of the present invention to provide a safety mat securement assembly that can be used to secure a safety mat to or near the base of a climbing wall assembly. It is another advantage of the present invention to secure the safety mat in an upright or storage position against the climbing wall in a manner so that a child or other climber is deterred from entry between the climbing wall and the mat. It is another advantage to provide a security system which communicates to children via a clear message that climbing is not to take place. It is yet another advantage of the present invention to provide a safety mat securement assembly that is easy to latch and unlatch so that the climbing wall is either readily accessible or in a closed state. It is a further advantage of the present invention to provide a safety mat security assembly which utilize components which can be used as a hand hold and mat for a climbing wall assembly. It is another benefit of the invention to provide safety mat structures which are economical and which provide a cushioned shock absorbing structure adjacent climbing wall assemblies.

These and other benefits of this invention will become clear from the following description by reference to the drawings.

DESCRIPTION OF THE PREFERRED EMBODIMENTS

The safety mat structures and safety mat securement assemblies of the present invention are constructed and arranged for use with climbing walls, i.e., for artificial walls, free standing, existing walls and panels attached to existing support wall structures. The safety mat securement assembly comprises security handhold members, safety mat top and side loop members, and bottom mat securement members to secure the cooperating safety mat to or near the climbing wall assembly. The securement assembly provides two positions for the safety mat structure used with a climbing wall assembly, namely, on the floor or against the wall, thus making the climbing wall open or closed for use. The security hand hold members are constructed and arranged to be incorporated onto a climbing wall assembly, for example, using screws or other fasteners known in the art, and may be used as a hand hold for climbing the wall. Alternatively, other locking means may be utilized to secure the safety mat structure and which may be located on or near the climbing wall. The top and side attachment members, such as loop members are constructed and arranged to fit into and be secured within the security hand hold members or other locking means. The bottom securement members are constructed and arranged to be fastened or secured to or near the bottom of a climbing wall assembly.

When the safety mat structure is on the floor it is preferably adjacent and attached to the bottom of the climbing wall assembly using the bottom securement member(s). When the safety mat is against the wall it is preferably attached to both the bottom of the climbing wall using the bottom securement member(s) as well as to the positioned security hand hold or like members on the climbing wall using the top and side loop members, for example.

Figure 1:
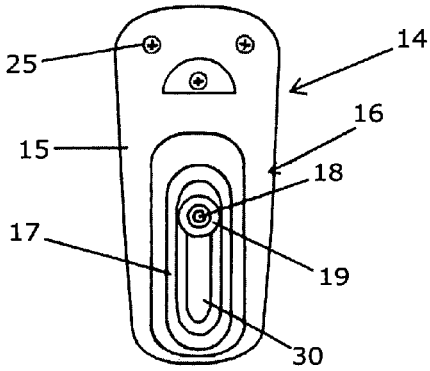
FIG. 1 is a front view of the security handhold member of the safety mat securement assembly of the present invention.
Figure 2:
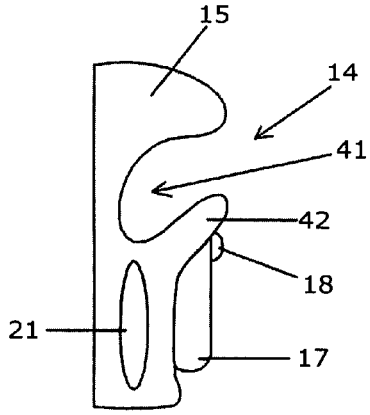
FIG. 2 is a side view of the security handhold member of FIG. 1 and showing the hand hold member in an open position.
Figure 3:
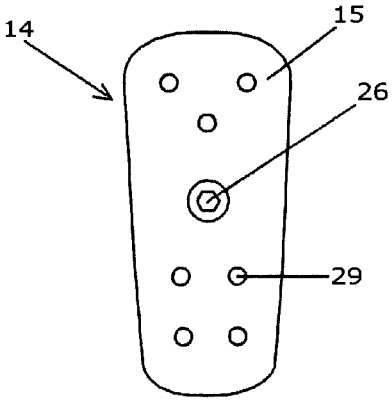
FIG. 3 is a rear view of the security hand hold member of FIG. 1.

Referring to FIGS. 1-3, security handhold member 14 is shown comprised of body member 15 and latching means 16. Body member 15 of security hand hold member 14 is constructed and arranged having concave opening 41 and grip portion 42 thereby enabling the security hand hold member to be utilized as a hand hold when not in use for holding a mat structure against a climbing wall. Latching means 16 is shown comprised of bolt or fastening member 18, corresponding fastener 26, washer 19 and latch member 17 having slot 30. The security handhold member 14 may be fastened to a climbing wall assembly using fasteners 25 that extend through apertures 29 of the body member 15. The security hand hold members 14 may be mounted or fastened to a climbing wall using any fastening means known in the art, for example with wood or concrete screws or other means. Logo label 21 is shown located on, i.e., molded into, the side of body member 15 to identify the manufacturer or manufacturer's mark, but may be located anywhere thereon. The handhold members of the present invention are preferably made of a polymeric structure, i.e., a molded plastic or urethane resin.

Figure 4:
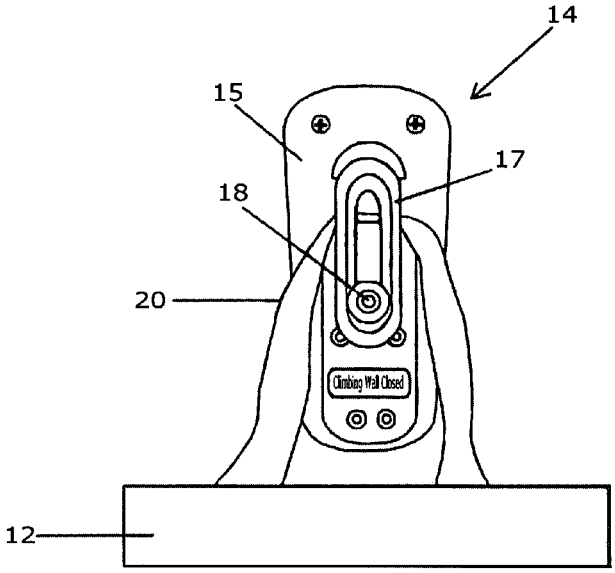
FIG. 4 is a front view of the security handhold member in a closed position.

To engage the latching means 16 in its locking and unlocking function, bolt member 18 is loosened, latch member 17 is slid up or down along slot 30 and bolt member 18 is tightened when the latch member is in its desired position. FIG. 4 shows the latch member 17 of handhold member 14 in a locked position and having a top loop member 20 of a safety mat structure 12 secured behind latch member 17.

Alternatively, the handhold member may incorporate a locking system. For example, a key lock or a combination lock may be incorporated into or used in conjunction with the handhold assembly. Thus, after a loop member is positioned onto a grip portion of the hand hold member and the latch member is placed in the locked position, the latch member may be locked in position via a lock key or combination lock (not shown) thereby preventing any tampering. The locking system may be incorporated into the assembly or a separate lock may be used with aligned apertures in the latch member and a portion of the handhold member.

The safety mats of the present invention provide a shock absorbent structure for landing on when using a climbing wall. The safety mats may have various embodiments comprising an exterior cover having an interior shock absorbing structure. The safety mats may be between one to six inches in thickness. For example, in one embodiment the safety mat structure may be approximately two inches thick and constructed of a layer of approximately one inch cross-linked polyethylene foam laminated or bonded to a layer of approximately one inch polyurethane foam. The mats are also preferably covered with a 18 oz vinyl with polyester reinforced material, for example. The safety mats 77 may be approximately four feet wide by six feet long and have Velcro® (hook and loop) fasteners on each side so that they may be attached to additional mats to form a safety mat structure 12 to span an area containing a climbing wall. The visible or bottom side of the mat structure when the mat structures are secured to the hand holds preferably contains a message to communicate that climbing is not to take place, for example a "No Climbing", "Wall Closed" or like message.

Figure 5A:
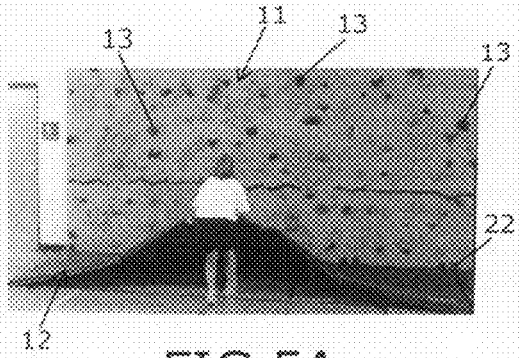
FIG. 5*a* shows a climbing wall assembly having a safety mat assembly being lifted from a usable position to a secured closed wall position.
Figure 5B:
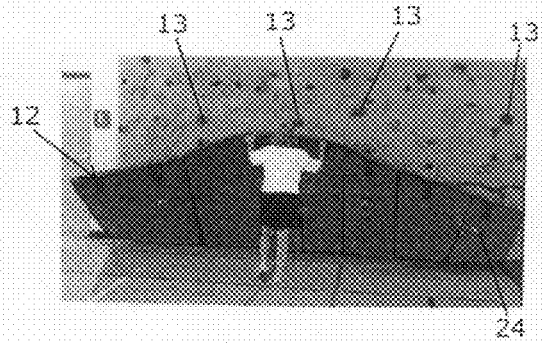
FIG. 5*b* shows a climbing wall assembly having a safety mat assembly being lifted from a usable position to a secured closed position.
Figure 5C:
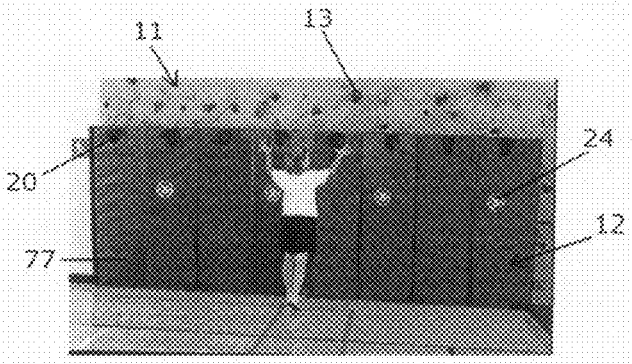
FIG. 5*c* shows a climbing wall assembly having a safety mat assembly being positioned into a secured closed wall position.

FIGS. 5*a*-5*c* show the sequence of a climbing wall assembly 11 having a safety mat assembly 12 being lifted from open position to closed position. Climbing wall assembly 11 is shown having hand holds 13 and a safety mat structure 12. FIG. 5*a* shows the mat structure 12 being initially lifted off the ground. Bottom securement members 22 are shown. FIG. 5*b* shows the mat structure being further lifted and FIG. 5*c* shows the mat structure 12 in position against the climbing wall assembly 11. Warning message 24, i.e. "No Climbing" or "Wall Closed", is shown on the underside of the mat structure 12 to inform users that the wall is closed. A warning message may be applied to a mat structure via a silk screen printing process or another like process.

Figure 6A:
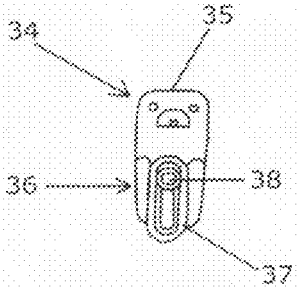
FIG. 6*a* shows a security handhold member in the open position.
Figure 6B:
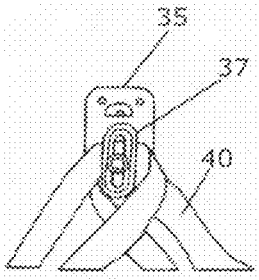
FIG. 6*b* shows the latch member of a security handhold member being slid to a closed position.
Figure 6C:
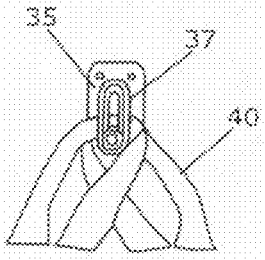
FIG. 6*c* shows a security handhold member in locked position and securing a pair of loop members.

FIGS. 6*a-c* show an alternate embodiment 34 of the handhold member, which locks and unlocks in a similar manner to the embodiment described with respect to FIGS. 1-4. Handhold embodiment 34 is shown having body member 35 and a latching means 36 comprising latch member 37 and bolt member 38. FIG. 6*a* shows the latch member 37 in an open position. FIG. 6*b* shows two top loop members 40 from a mat structure secured behind the latch member 37 which is being slid upwards into the locked position. FIG. 6*c* shows the latch member 37 in a closed position, holding the top loop members 40 in place, and thus effectively closing a climbing wall assembly by securing the mat to the front of the climbing wall.

Figure 7:
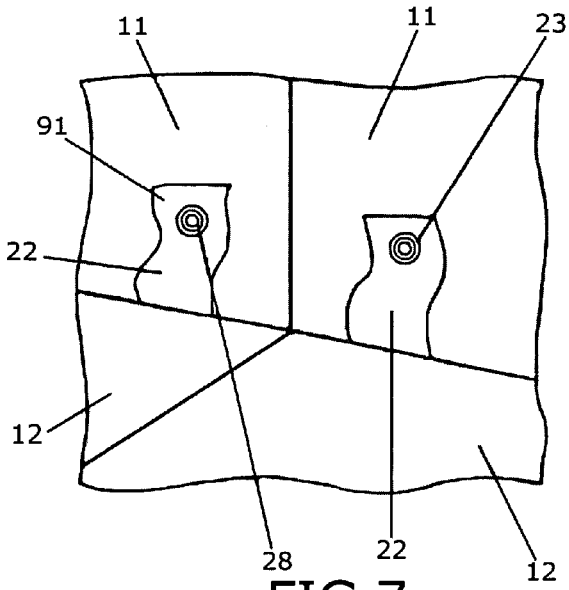
FIG. 7 is a perspective view of a bottom securement member of the safety mat securement assembly of the present invention.
Figure 9:
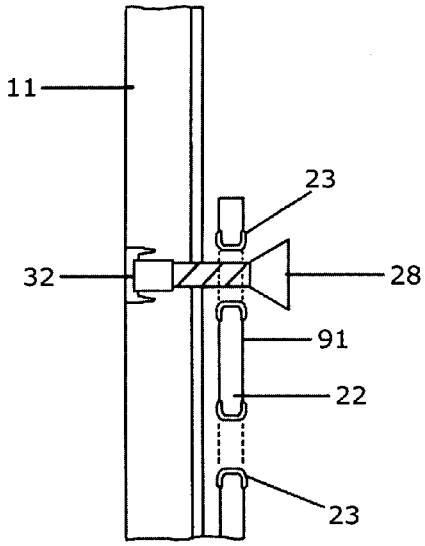
FIG. 9 is a cross-sectional view of a bottom securement member of the present invention.
Figure 10:
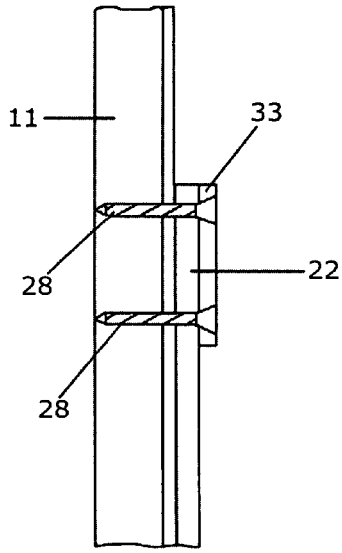
FIG. 10 is a cross-sectional view of an alternate embodiment of the bottom securement member.

FIG. 7 shows mat structure 12 having bottom securement member tabs 22 utilizing grommet 23 for attachment of the mat structure to a wall or climbing assembly 11, using fastener 28, for example a flat head cap screw. A thermoplastic coating 91 is shown on tab 22 and which is provided to secure grommet 23 within the tab structure. FIG. 9 is a cross-sectional view of an alternate embodiment of the bottom securement member 22 being attached to the climbing wall 11 using cooperating fastening components 28 and 32 and grommet 23. A second grommet 23 is shown disposed on bottom securement member 22 to further secure member 22 using cooperating fastening components 28 and 32. Fastener 32 may be a t-nut, for example and is used in conjunction with fastener or screw 28 to form a fastening structure to hold the bottom securement member 22 to a paneled climbing wall 11. Any means known in the art may be used to attach the bottom securement members to a climbing wall including, for example, plates made of wood, plastic, metal or another like material may be utilized to secure the securement members to a wall. FIG. 10 shows plate member 33 utilized to secure the bottom securement member 22 to climbing wall assembly 11 via fasteners 28. The plate member 33 may have the width of the securement tab 22 and which maintains the integrity of the tab structure (webbing stitched or fastened to the mat body) during use.

Figure 8:
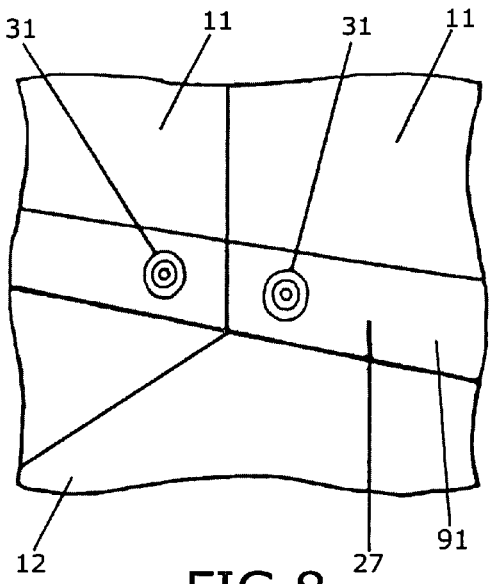
FIG. 8 shows a bottom flap securement member.

Preferably, each mat structure has a plurality, i.e., two top loop members securely attached to the top of the mat and two bottom securement member tabs attached to the bottom, although other numbers of top loop members and configurations of bottom securement members are within the purview of this invention. As further discussed below, side loops may also be utilized to secure the mat structure to the climbing wall. FIG. 8 shows an attachment embodiment 27 comprising a bottom securement flap. Bottom securement member flap 27 is shown having grommets 31 and attached to mat structure 12. Bottom flaps 27 may be provided in various sizes to accommodate various climbing wall configurations, for example 4 inch and 12 inch wide flaps and which may extend along the entire length or width of the mat. The top loop members and bottom securement or attachment members may be sewn to the safety mat or attached using other fastening means known in the art. The top loop members are preferably constructed of a reinforced polymeric material, i.e., nylon, vinyl or like material, for example, webbing similar to that used for auto seatbelts. The bottom securement tabs are preferably also constructed of webbing or like strong materials.

The bottom flap portion 27 is shown extending continuously along the bottom length of the securement mat structure, i.e., 1-12 inches in width or height, to thereby limit space between the mat and the climbing wall in both the open and closed positions and to thereby minimize unauthorized access.

The bottom tabs 22 or the continuous flap 27, shown in FIGS. 7 and 8 are preferably constructed having a thermoplastic polyurethane coating 91 to strengthen the securement of the grommets 23 and 31 in the respective tab or flap structures. The polyurethane coating may also be used with other reinforcements of the tabs or flap structures. The polyurethane or like coatings reduces the stretchiness of the tab or flap materials to thereby maintain and stabilize the grommets within the structure. The bottom tabs and/or flaps may be attached to the bottom of the climbing wall, to the existing wall below the climbing wall or to the floor adjacent either wall.

Figure 11:
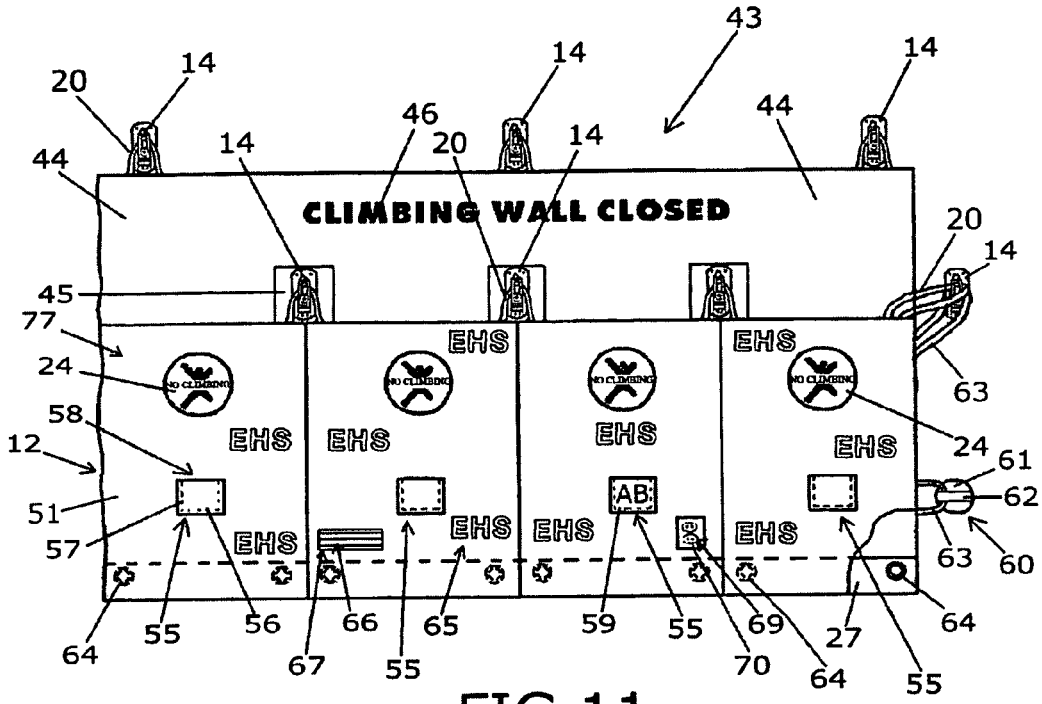
FIG. 11 is a frontal view showing the safety mat securement assembly of the present invention in the closed position and in use with a top cover member.

FIG. 11 shows safety mat structure 12 in an upright or locked position against climbing wall assembly 11. Top cover member 43 is provided and shown in use with the safety mat securement assembly of the present invention. Top cover member 43 is provided to enable the exposed climbing wall portion to be covered and locked, for example, by spanning the exposed climbing wall above the safety mats. For example, if the climbing wall is ten feet high and the safety mats are six feet tall, then four feet of the climbing wall would remain exposed above the safety mats when in a locked position. The top cover member 43 of the present invention may be a reinforced fabric, a plastic coated fabric, or a polymeric flexible material, i.e., made of "vinyl", a plasticized polyvinylchloride or a like material and can be constructed of various lengths and widths, for example, to cover various sizes of climbing walls. The top cover member 43 preferably adds security to the safety mat securement assembly of the present invention as well as providing a system that is light in weight, affordable and easy for one person to maneuver.

The top cover member 43 may be held in place, above or on the top portion of the climbing wall assembly, for example using Velcro® (hook and loop fastener system), specially designed hand holds, pulleys, grommets, hooks, other securement structures and combinations thereof. FIG. 11 shows top cover member 43 having elongated flexible body 44 being held in place by loops 20 within cooperating security handhold members 14 which are shown mounted on the wall above the climbing wall. When securing a climbing wall using the top cover member 43, the flexible body 44 of the top cover 43 is first spread along the exposed wall portion of the climbing wall and securing the loops to the hand hold members 14 shown above the climbing wall. For example, flexible body 44 is shown to have apertures 45 which expose security handhold members 14 which are mounted on the climbing wall and which are used to secure safety mat 12 as discussed above. Thus, when the security handhold members 14 are in the locked position, the apertures function to hold the top cover member in place. Informational or warning message 24 is shown printed on the surface of safety mat 12. Further enlarged warning message 46, "CLIMBING WALL CLOSED", is shown disposed on the top portion of top cover member 43. The warning messages may be affixed to the safety mat and the top cover member via a silk screen printing process or other printing means.

Referring to FIG. 11, a climbing wall is shown covered by a securement mat assembly 12 comprising individual mat portions or panels 77. The top loops 20 and side loops 63 are shown secured in a single securement handhold structure 14. The securement structure may be mounted on or adjacent the climbing wall. The securement handhold structures may be mounted to the climbing wall utilizing wood screws or other fastening means to thereby allow handhold positioning wherever deemed necessary and thus not limited by T-nut positioning for securement. This sharing of loops in a single handhold is shown in FIGS. 6*a*-6*c*. Although loops are shown attached to the mat for securement purposes, cables attached to the mat structure may also be utilized to secure the safety mat. Mat assembly 12 is shown attached to the bottom of the climbing wall by bottom securement flap 27 having grommets 64 through which a fastener may be utilized, as described above.

It is also within the purview of this invention to secure a mat that does not utilize bottom securement tabs or top loop members. For example, a webbed envelope structure having bottom securement tabs or a continuous flap and top loop members as described above may receive a mat for use with the security hand hold members of the present invention. In essence, the absorbent mat structure is enveloped into a webbed envelope which is provided with attachment structures.

As further shown in FIG. 11, the securement mat 12 is shown to have window structures 55 secured thereto. The window structures 55 are shown to have a clear plastic member 56 which is affixed to the mat structure 12 by means of peripheral fastening means 57, i.e., stitching, adhesive or the like. The window member 55 has a clear plastic member 56 with an open upper side 58. An insert 59 is shown in one of the window members 55. Further, loop members 20 are shown secured to the side of the mat 12, and used in conjunction with security hand hold members 14. The lateral securement prevents children from climbing or entering behind the mat 12 when it is secured to the climbing wall. Further, locking member 60 is shown positioned to the side of the climbing wall and having body 61 and latch 62. The locking member 60, for example, may not be a hand hold and may be constructed and arranged to only secure a mat loop member 20. The locking member 60 may have a loop holding and securing portion with a lock, i.e., requiring a key or combination or may comprise a lock itself which is secured to the wall. The securement structures 14 and 62 may be positioned as shown or may be positioned on or near the climbing wall. Although the loop members 20 are shown to be unitary structures, they may be formed of multiple pieces and then united to form a single structure.

Figure 12A:
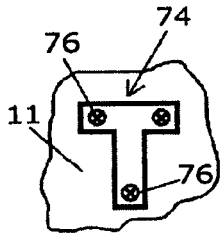
FIG. 12A shows a letter mounted to a climbing wall.
Figure 12:
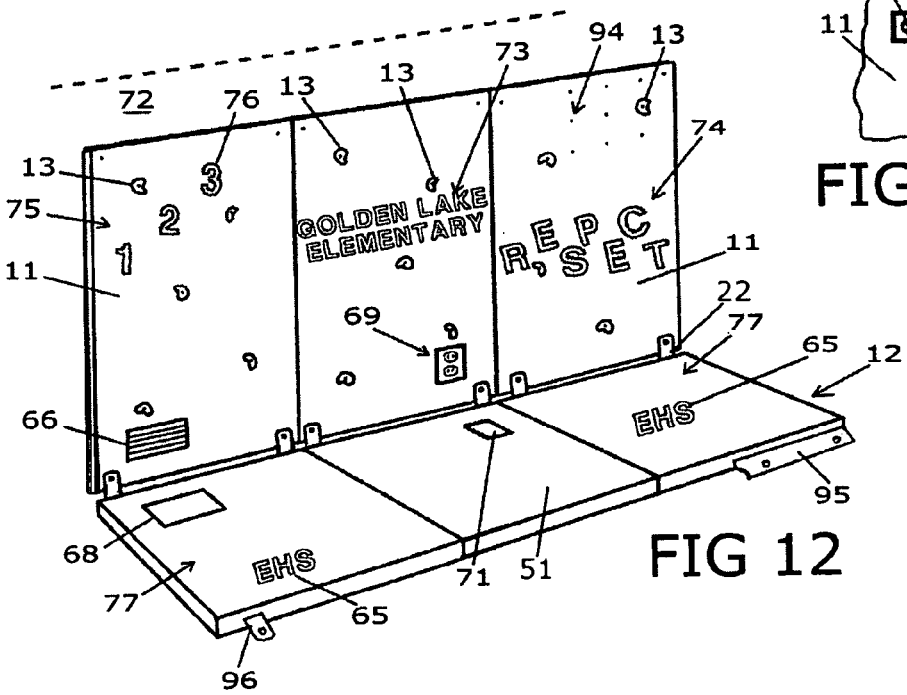
FIG. 12 is a perspective view of the safety mat securement assembly and showing the safety mat in an open position.

Referring to FIGS. 11 and 12, the securement mat 12 is shown having top loops 20 that are shown secured in a securement handhold structure 14. The top loops 20 are shown attached at the top of the securement mat 12 with one end of each loop structure being fastened to adjoining mat segments or panels 77. A center panel is shown having a generally rectangular cut out 70 to expose an electrical outlet 69 contained on gymnasium wall 72. Another mat cut-out 67 is shown to expose a vent 66. Because a continuous securement mat may cover an existing power outlet or heating or cooling vent on a gymnasium wall, for example, the securement mat may have predetermined cutouts which are readily removable to expose and permit access to the outlet or to provide access to other elements.

As shown in FIG. 12, a generally rectangular plug structure 71 is shown inserted into the cutout 70 to thereby provide a continuous securement mat use. The plug insert 71 is preferably constructed of the same material as the mat construction itself, i.e., vinyl cover, foam interior. Additionally a hook and loop, i.e., Velcro-type fastening system may be utilized to secure the insert plug 71 into the cutout portion 70 of the mat 12. The insert plug 71 may also have a handle member, i.e., a flexible looped handle member, on its side (not shown) to aid a user to remove and install the insert plug. FIG. 12 further shows the top of mat structure 12 having a tab 96 and an elongated flap member 95. These attachment structures are provided to show that loops, tabs or flaps may be used as attachment means on the bottom, sides or top portions of the safety mat. Bottom securement tabs 22 are shown attaching mat structure 12 to climbing wall 11.

Referring again to FIGS. 11 and 12, an EHS logo 65 is shown printed or otherwise positioned on the exterior cover 51 of the securement mat structure. The EHS logo 65 for example, may be the logo of the school in which the climbing wall and securement mat is utilized, and the school logo may be disposed over the entire surfaces of the mat. Thus, when the climbing wall is in the locked or closed position, the school logo 65 or other printing or advertising is viewable within the gymnasium. Additionally, or in the alternative, the school logo 65 or other design may be positioned on the front of the mat (FIG. 12) so that the images are seen when the climbing wall and safety mat are in the open position.

FIG. 12 further shows a school logo comprised of letters mounted to the climbing wall surface. The logo, school name or other lettering may be mounted via wood screws, for example, into the climbing wall. FIG. 12A shows the letter T secured by screws 76 and wall 11. The screws 76 permit proper spacing of the letters and do not require the use of the T-nut apertures 94 present in the climbing wall. The latter apertures 94 restrict the placement of letters or numbers, etc., on the climbing wall surface. Other numbers 75 and letters 74 may also be screwed into, or otherwise fastened onto, the climbing wall surface 11. For example, color coded letters forming words, for example, may be used for character building purposes, i.e., red—caring, green—respect, blue—honesty, etc., so that a passing climber is reminded of these virtues, i.e., the word RESPECT. The utilization of screws and like fasteners permits letters, numbers, special handholds, etc. to be positioned on the climbing wall in positions other than those provided by the T-nut apertures 94, which are preset in a pattern in the climbing wall panel.

In summary and referring to FIGS. 12 and 12A, letters, numbers and words are shown mounted to the climbing wall 11. The letters 74 and numbers 75 have apertures through which fasteners such as wood screws 76 for securement to the climbing wall. As shown, a climbing wall typically has a plurality of spaced apertures 94 in which T-nuts are mounted and which are typically used to mount hand holds, wall plates and the like. Although these apertures could be used to secure letters, numbers, etc., the spacing of the T-nut apertures 94 are not suited for letter placement, particularly when forming words, such as a school name, i.e., GOLDEN LAKE ELEMENTARY. Thus, the letters and numbers have a plurality of holes, i.e., three, through which screws may be used to thereby properly space and mount the numbers and letters to the climbing wall surface.

Figure 13:
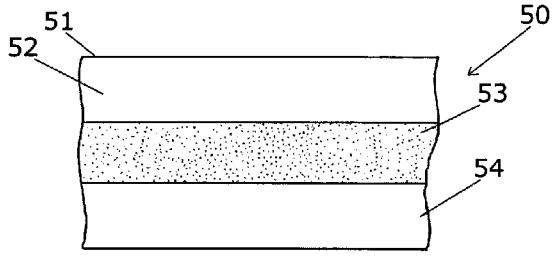
FIG. 13 is a sectional view of a safety mat structure for use in climbing wall environments.

Safety mat structures of the invention may have various embodiments including covered, foam cushioned structures and inflatable mats having self inflating pumps. FIG. 13 shows safety mat structure 50 having a generally planar body comprised of first layer 52, second layer 53 and third layer 54 placed within exterior cover member 51. Layer 53 is preferably constructed of polyurethane foam and layers 52 and 54 are preferably constructed of a cross-linked polyethylene foam. The three layers may be laminated or otherwise secured into a unitary structure. Each layer may preferably be approximately one inch thick. Thus, each mat structure 50 may have an approximate three inch total thickness, within a range of 1-6 inches, and is preferably covered with 18 ounce vinyl with polyester reinforcing, for example. The mats are preferably four by six square feet in area and include a fastener, such as Velcro® (hook and loop) on at least two sides for attachment to other mats and to the base of a climbing wall when in an unlocked or open position. The underside of each mat preferably contains a warning or informational label that is visible when the mat is in a closed or locked position indicating that no climbing may take place.

Figure 14:
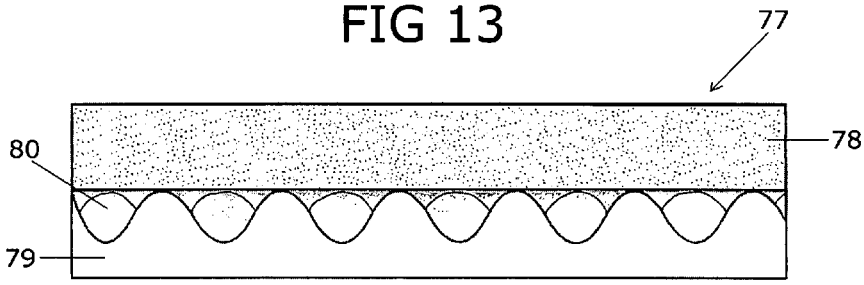
FIG. 14 is a cross-sectional view of another safety mat structure of the invention.
Figure 15:
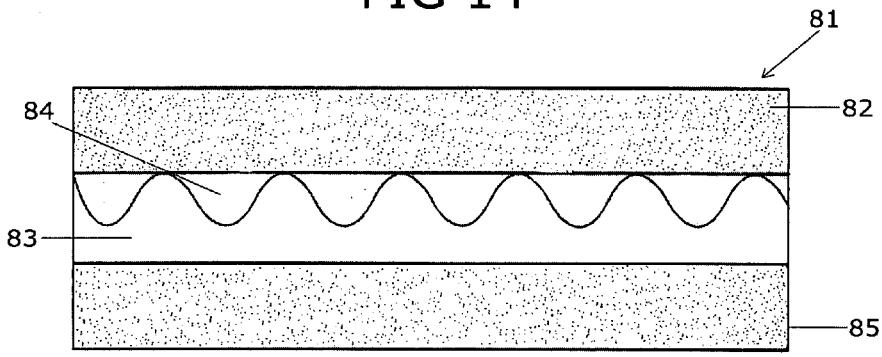
FIG. 15 is a cross-sectional view showing another embodiment of a safety mat structure.

FIGS. 14-17 are cross-sectional views showing other safety mat interior structures which when covered make up the safety mat structure. The exterior cover member 51, as shown in FIG. 13, may also be used to cover the interior structures of FIGS. 14-17 and is preferably a vinyl (polymeric) material which may also have a woven or mesh reinforcement for strength and which may have a weight range between 12-21 oz., i.e., 18 oz. vinyl. FIG. 14 shows a layer of polyethylene foam 78 and a formed or convoluted foam structure 79 which creates a plurality of cavities 80 within the overall structure. The convoluted configuration may be obtained from a single cut foam piece to thereby create two similar convoluted foam structures 79. As shown in FIG. 14, the convoluted pattern has a design similar to that of an egg carton type mattress pattern. In use, the air cavities 80 provide an added force absorbent when utilized. FIG. 15 shows mat structure 81 having the convoluted foam layer 83 sandwiched between upper and lower polyethylene foam layers 84 and 85.

Figure 16:
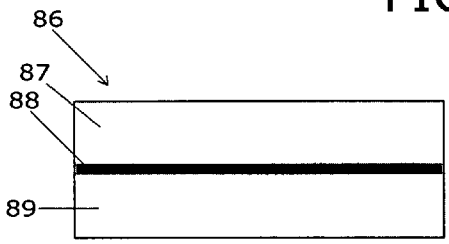
FIG. 16 is a cross-sectional view showing another embodiment of a safety mat structure.

FIG. 16 shows an insert layer 88 positioned between upper and lower polyethylene foam layers 87 and 89. The insert layer 88 may be preferably a more rigid polymeric sheet which is utilized to absorb a shock force to thereby increase the overall shock force absorbency of a securement mat when compared to a similar mat structure having only the polyethylene foam layers. The insert layer 88 is also useable in other mat structures, i.e., multiple layered structures including convoluted layered mat structures and multiple insert layers may be utilized in a mat configuration, i.e., between multiple foam layers. In addition to the insert layer providing impact absorbency, it also provides a lower flame spread potential.

Figure 17:
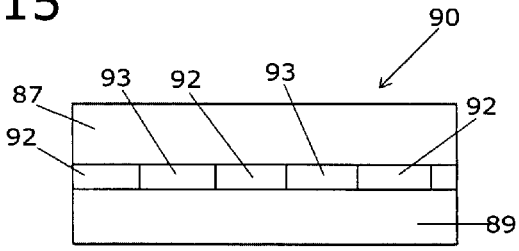
FIG. 17 is a cross-sectional view showing another embodiment of the safety mat structure of the invention.

FIG. 17 shows a mat structure 90 having top and bottom layers 87 and 89, i.e., expanded polyethylene foam or the like having a middle layer 92 with cavities 93. The middle layer 92 may have a variety of forms, all providing a plurality of interspersed cavities between the top and bottom layers. For example, the middle layer may comprise a plurality of spaced foam elements such as rectangular or other shaped foam pieces 92 disposed between the upper foam layer 87 and the lower foam layer 89 to provide a plurality of cavities 93. Alternatively, a center layer of foam having a smaller area than the upper and lower layers may be provided having a series of cuts whereby when the smaller area center layer is stretched into an area to match the size of the upper and lower layers a series of open spaces are provided in the mat structure. In the latter embodiment, less foam, i.e., 50%, may be used in the middle layer of the mat structure and the center layer due to stretching provides a thinner, more dense foam center layer.

As many changes are possible to the safety mat securement assembly of this invention, utilizing the teachings thereof, the description above and the accompanying drawings should be interpreted in the illustrative and not the limited sense.

That which is claimed is:

1. A safety mat assembly comprising:

a) a generally planar mat body having a cushioned, fire resistant body, a fire resistant flexible cover enveloping said mat body, said flexible cover having a generally rectangular periphery with a top, sides and a bottom, and top, side and bottom attachment means extending from said cover periphery, said top and side attachment means being loop structures and said bottom attachment means being an elongated flap member which extends along said bottom of said mat body, said flap member having a polymeric coating and further having at least one grommet extending therethrough;

b) a climbing wall structure having a plurality of handholds and having a top and a bottom, said bottom constructed and arranged to receive said elongated flap member so that the mat body can pivot about said elongated flap member and cover said climbing wall; and c) securement means mounted with respect to said climbing wall structure for receiving said top and side attachment means of said planar mat body, said securement means comprising a handhold with a rigid loop locking means and being constructed and arranged having a formed cavity to receive said loop structures of said top and side attachment means so that said mat body can be secured in a pivoted position against said climbing wall.

2. The safety mat assembly of claim 1, wherein said securement means are located on or near the top, bottom and sides of said climbing wall structure.

3. The safety mat assembly of claim 1, said assembly further includes a flexible top cover member constructed and arranged to be secured at the top of said climbing wall, said cover member having attachment means extending therefrom.

4. The safety mat assembly of claim 1, wherein said mat body comprises a cushioned layered body comprising a top layer, a middle portion and a bottom layer, and wherein said middle portion is a body layer forming cavities between said top and bottom layer.

5. A safety mat securement assembly for a climbing wall comprising:

a) a climbing wall having a top and a bottom;

b) at least one generally planar safety mat structure having a thickness, a first end and a second end, said safety mat structure is constructed and arranged having at least one top mat attachment loop member at said first end and at least one bottom mat attachment flap extending along said second end, wherein said at least one bottom mat attachment flap is constructed and arranged having at least one aperture therethrough, thereby allowing said flap to be secured using a fastener at or near the bottom of said climbing wall so that said safety mat structure can pivot about said at least one bottom mat attachment flap, said safety mat structure having a height that extends substantially the height of the climbing wall, said safety mat structure further having a flexible planar structure with a shock absorbent member and an exteriorly disposed cover structure, said at least one top mat attachment loop member extending from said cover structure;

c) at least one top mat securement member disposed on or near said climbing wall and constructed and arranged having means to receive and secure said at least one top mat attachment loop member; and d) a flexible top cover member having loop structures and which is constructed and arranged to be secured at the top of said climbing wall and to extend to at least the top of said safety mat structure, so that the top of said climbing wall can be covered by said top cover member and said top cover member can be secured against said climbing wall.

6. The safety mat securement assembly of claim 5, wherein said shock absorbent member comprises a compressible foam structure having a plurality of polymeric layers.

7. The safety mat securement assembly of claim 6, wherein said polymeric layers include a first layer of cross-linked polyethylene foam and a second layer of formed or convoluted polyurethane foam which creates a plurality of internal cavities in said safety mat structure.

8. The safety mat securement assembly of claim 5, wherein said safety mat structure further has a top surface and a bottom surface and wherein an aperture is provided on said mat structure, and wherein an insert is provided for removable securement in said aperture.

9. The safety mat securement assembly of claim 5, wherein said safety mat structure has a top, a bottom and sides, wherein said top mat attachment loop member is attached to said top and sides and wherein said safety mat structure is constructed of fire resistant materials.

10. A safety mat securement assembly comprising:

a) an artificial climbing wall having a top and a bottom;

b) at least one safety mat structure having a first end, a second end and a thickness, said safety mat structure having top mat attachment means at said first end and bottom mat attachment means at said second end, said top mat attachment means comprising at least one loop member and said bottom mat attachment means being constructed and arranged to secure said mat structure at or near the bottom of said climbing wall so that said mat structure is pivotable about said bottom mat attachment means;

c) at least one loop securement structure for placement on or near said climbing wall, wherein said securement structure is constructed and arranged having a rigid body having a formed cavity for receiving said at least one loop member and further having a locking member for closing said cavity and securing said loop member therein so that said mat structure can be secured in a pivoted position against said climbing wall; and d) a cover member constructed of reinforced polymeric material for enveloping said safety mat structure, said cover member having a first side and a second side and having printed indicia on said second side, said printed indicia being functionally related to the use of said climbing wall, said first side of said cover member being adjacent said climbing wall when the mat structure is pivoted against said wall and said printed indicia on said second side being visible when said mat structure is pivoted against said wall and stating that the climbing wall is closed when said mat structure is secured against said climbing wall.

11. The safety mat securement assembly of claim 10, wherein said bottom mat attachment means is an elongated flap member attached to one side of said safety mat structure, said elongated flap constructed and arranged to be secured at or near the bottom of said climbing wall.

12. The safety mat securement assembly of claim 11, wherein said elongated flap member contains at least one grommet for receiving at least one fastener for attachment at or near said bottom of said climbing wall.

13. The safety mat securement assembly of claim 10, wherein said safety mat structure comprises at least two polymeric layers.

14. The safety mat securement assembly of claim 13, wherein said layers include a first cross-linked polyethylene foam layer and a second formed or convoluted polyurethane foam layer which creates a plurality of cavities in said safety mat structure.

15. The safety mat securement assembly of claim 10, wherein said safety mat securement assembly further includes a side attachment means and wherein said side attachment means comprises a loop or tab member and a cooperating securement structure.

16. The safety mat securement assembly of claim 10, wherein said assembly further includes a flexible top cover member constructed and arranged to be secured at the top of said climbing wall, said cover member having attachment means extending therefrom.

17. The safety mat securement assembly of claim 1, wherein said flap member is attached to said climbing wall using a fastener extending through said at least one grommet.

* * * * *